US005882365A

United States Patent [19]

Farjon et al.

[11] Patent Number: 5,882,365

[45] Date of Patent: Mar. 16, 1999

[54] SOOT DISAGGREGATING COMBUSTIBLE AGENT

[75] Inventors: Thierry Farjon, Chanteloup les Vignes; Oliver Boinet, Paris, both of France

[73] Assignee: Eurexim, France

[21] Appl. No.: 947,627

[22] Filed: Oct. 9, 1997

[30] Foreign Application Priority Data

Oct. 10, 1996 [FR] France ..... 96 12365

[51] Int. Cl.[6] ..... C10L 10/06

[52] U.S. Cl. ..... 44/535; 44/553; 44/555; 44/557; 44/575; 44/576; 44/580; 44/590

[58] Field of Search ..... 44/575, 535, 553, 44/555, 557, 576, 580, 590

[56] References Cited

U.S. PATENT DOCUMENTS

| | | | |
|---|---|---|---|
| 2,777,761 | 1/1957 | Tarnoski | 44/5 |
| 3,297,419 | 1/1967 | Eyre, Jr. | 44/6 |
| 3,637,355 | 1/1972 | Brockbank | 44/1 R |
| 3,951,613 | 4/1976 | Kiele | 44/5 |
| 4,062,655 | 12/1977 | Brockbank | 44/6 |
| 4,147,518 | 4/1979 | DeHart et al. | 44/13 |
| 4,481,010 | 11/1984 | MacKowiak et al. | 44/5 |
| 5,284,636 | 2/1994 | Goff et al. | 423/235 |

FOREIGN PATENT DOCUMENTS 2 554 458 5/1985 France .

*Primary Examiner*—Jerry D. Johnson
*Attorney, Agent, or Firm*—Millen, White, Zelano, & Branigan, P.C.

[57] ABSTRACT

Solid combustible agent for disaggregating soot and tarry deposits in chimney flues, said agent comprising an aggregate of cellulosic particulate material, chemical and/or catalytic soot disaggregating agent and binder. This agent is preferably used alone, i.e. in the substantial absence of an already ignited fire, when combusted to treat the flue.

20 Claims, No Drawings

SOOT DISAGGREGATING COMBUSTIBLE AGENT

FIELD OF THE INVENTION

This invention relates to the chemical and/or catalytic cleaning of combustion devices and chimney flues. It relates more specifically to a solid combustible agent for chemically and/or catalytically disaggregating soot, a process for manufacturing said agent and the use thereof.

Soot in the present disclosure is intended to mean deposits of any kind which form in heating devices and particularly in chimney flues. These deposits may be of various nature, such as particles of carbonaceous materials, flying ash and chiefly tars. The latter settle mainly in the lower portion of the flue ducts or chimneys. Formation and settling of these materials are dramatically increased when burning solid fuels such as coal and wood, particularly when using airtight stoves.

STATE OF THE PRIOR ART

The increased settling of these materials, and above all tars, in chimneys is dangerous since these materials are flammable and can be responsible for fires in chimneys. They are also responsible for a decreased draft in chimneys and combustion devices since they decrease the flue section. Conventional sweeping with a flue brush is not effective with tars which form a hard layer strongly adhered to the walls, so that even after mechanical sweeping, a fire in the chimney can again occur.

Materials for the so-called chemical or catalytic cleaning of chimneys are replete on the market. Some of these contain sulfur whose purpose is to decompose soot and tars to make them more flammable with all the resulting risks, such as a fire in the chimney, since the flue must be heated to a maximum to make the material operative; there also remains a risk of damage to the flue when using caustic soda or decomposition products thereof The scientific literature and patents disclose many other chemical or catalytic agents intended to inhibit the settling of deposits in furnaces and chimneys or even to disaggregate these deposits once formed; these agents unhappily cannot be handled easily in many cases, particularly when present as a liquid or a powder. The liquid agents require injection nozzles and, their use is not feasible with domestic heating devices; the powdered agents cannot be used easily since a powder in more or less precise dosage must be sprinkled onto a fire of variable intensity, whose measure and control cannot be carried out easily.

Finally a large portion of the powder or decomposition products thereof is lost in the atmosphere which results to losses and pollution hazards.

FR-A-2 554 458 discloses a solid combustible agent for preventing or curing soot in heat generating devices. The agent comprises e.g. wood particles, a soot preventing or curing agent and a binder. The agent is used in an active conventional fire in low proportion, e.g. a few tens of grams of active material per each metric ton of fuel.

The use of wax as binder for sawdust in artificial logs is known from U.S. Pat. No. 4,147,518, U.S. Pat. No. 3,297, 419 and U.S. Pat. No. 3,637,355. Chemicals in minor proportions may be added to improve the combustion or produce colored flames, but the resulting logs do not appear to have any effect on soot or tars in chimney flues.

GB-A- 2 145 731 discloses cellulose briquettes incorporating combustion modifiers such as sulfur oxyacid derivatives or phosphorus oxyacid derivatives.

GB-A- 1 001 772 discloses a cleaning agent for heat transfer surfaces which comprises a mixture of potassium nitrate and a combustible material. This agent is introduced into a hot furnace.

U.S. Pat. No. 4,481,010 discloses a creosote and soot removing composition comprising a metallic chloride and trisodium phosphate, said composition being sprinkled onto a fire.

U.S. Pat. No. 2,777,761 discloses a composition comprising ammonium chloride, copper sulfate and wood flour which assists in the burning of soot and carbon deposits in combustion chambers, flues, etc.

WO-A- 82 04065 discloses a process for removing soot from enclosed spaces comprising the introduction of steam saturated with specific chemicals.

U.S. Pat. No. 5,284,636 discloses the use of phosphorous oxide to stabilize the ash produced by the combustion of a heavy metals containing fuel.

DE-A- 3 429 584 discloses a combustion improving composition comprising a number of chemicals including ammonium compounds which are said to clean heating devices and flues.

To resume, while a number of soot inhibiting or soot removing (disaggregating) agents have been disclosed, it appears that none of them has been used in the same compositions or in the same manner as in the present invention.

The disadvantages of the cleaning agents of the prior art are reduced or suppressed when using the solid agent for disaggregating soot, or cleaning agent, according to the invention, particularly when operating according to the preferred embodiment of use of this agent.

BRIEF SUMMARY OF THE INVENTION

The invention is based on the new concept of manufacturing a solid combustible material incorporating an agent for disaggregating soot and specially tars. When this material is combusted, particularly in the absence of a previously ignited fire, the agent for disaggregating soot is progressively released and comes into contact with the soot and tars.

The cleaning agent according to the invention thus consists of a solid aggregate comprising, as essential constituents:

a) a solid particulate combustible cellulosic material, b) a chemical and/or catalytic agent able to disaggregate soot, and c) a binder.

The above components are preferably present in substantially homogeneous admixture, although there can be provided, for example, successive layers of components (a) and (b) bound with component (c), or otherwise a final superficial coating of the mixture with the component (c) or (a) alone or with the mixture of (c)with (a), for example for accelerating ignition. In another embodiment the whole component (b) is arranged in the center of the composition or along the central axis thereof.

The cleaning agent according to the invention offers a number of advantages when compared with the prior known cleaning agents, such as: it is "autonomous", i.e. it is no more necessary to make a separate fire and to add thereto an artificial log or a powder in proportions not easily controlled; it can thus be used more easily by any user in hull security and confidence, particularly in strongly soiled chimneys where there is a high risk of fire.

it also performs better since the active material will be released smoothly all along the combustion thereof, which gives to the active material ample time to treat the tars, the combustion of the cleaning agent heating the tars up to a temperature well adapted to an efficient treatment. Cleaning is thus obtained more quickly than when using the known chemical and/or catalytic processes.

DETAILED DESCRIPTION

The solid particulate combustible cellulosic material preferably consists of wood particles, for example as sawdust, powder, chips, fibers or the like. Other combustible cellulosic materials can be used as well, such as crushed or ground cereal straw, crushed and dried residues from certain town refuses (vegetal residues) or residues from paper mills. The size of the particles is usefully between 0.1 and 10 mm for sawdust and wood meal. Other materials may be of greater length (chips or fibers) but are preferably from 0,1 to 2 mm thick.

The chemical and/or catalytic soot and tar disaggregating agent may be any agent known for that purpose. These agents can be found in large number in the scientific literature and patents. A non limiting list of these agents comprises ammonium salts such as ammonium chloride, nitrate, acetate or sulfate, potassium and/or magnesium acetate and nitrate, phosphates such as ammonium phosphates and alkali and alkaline earth metal phosphates, alkali and alkaline earth metal carbonates, oxides and hydroxides, such as for example those of sodium, potassium, calcium and ammonium. Compounds of multivalent metals such as copper, manganese, iron and cerium may have a catalytic effect and are thus useful in this invention, e.g. from 0.1 to 2% b.w. thereof. These compounds may be used as such or as mixtures.

Examples of such mixtures are:

- a mixture of potassium nitrate and ammonium sulfate (1:10 to 10:1 b.w.),
- a mixture of ammonium sulfate and magnesium chloride (2:10 to 10:2 b.w.),
- a mixture of dicalcium phosphate, ammonium chloride, iron sulfate and calcium nitrate,
- a mixture of ammonium phosphate, ammonium sulfate and copper nitrate,
- a mixture of potassium acetate and magnesium nitrate.

Improved results have been obtained with a mixture of P2O5 or phosphoric acid with an ammonium salt such as a mixture of phosphorus pentoxide and an ammonium salt in the relative proportions of 10–90% b.w. of the former and 90–10% b.w. of the latter, e.g. a mixture of phosphorus pentoxide and ammonium sulfate (1:10 to 10:1 b.w.) with or without added copper or manganese compound.

The way the soot and tar disaggregating agent (element b according to the invention) operates depends somewhat on the selected agent. However, irrespective of this agent, this way has not been fully understood up to now. It is apparent that these agents faciliate the conversion of the tarry deposits to powdered and poorly adherent ashes which separate more easily. The ammonium salts vaporize easily and appear to operate as strippers for the other inorganic compounds present. They have also themselves a self-disaggregating effect on the deposits.

It is thought that the mechanism is mainly chemical but the optional metal compounds such as iron, copper or manganese compounds may have a catalytic effect.

The above explanations must not be considered as limiting the scope of the invention in any respect whatsoever.

The binder consists of any material able to maintain the cohesion of the mixture of the elements (a) and (b). Preference is given to paraffin wax which is solid at room temperature. Paraffin wax is a material which burns by wick effect and which, once melted, may impregnate the elements (a) and (b) and, after cooling, maintains a good cohesion between these elements in the resultant solid material. Paraffin wax melting above 40° C. is preferred. Other useful binders are a naturally occuring, artificial or synthetic adhesive, for example a vinyl glue, a thermoplastic resin, an amylaceous matter or stearic acid.

The relative proportions of the elements (a,b,c) may vary broadly depending particularly on the nature of each element in the composition, its porosity, its combustibility and, as concerns the soot disaggregating agent, its efficiency.

In most of cases, the relative proportions by weight are in the range of 20 to 80% of (a), 10 to 40% of (b) and 10 to 70% of (c) for 100 parts of the mixture (a+b+c). Additional materials may be present, however, either as carriers, e.g. silica or silicates, or as combustion additives, or otherwise as aesthetics modifying agents, e.g. a dye or pigment, or for any other purpose. Their amount by weight will remain below half the proportion of (a+b+c) and will be preferably below 10% and better below 5% of this proportion.

The following proportions are preferred:

(a): 25 to 45% b.w.

(b): 15 to 30% b.w.

(c): 40 to 65% b.w.

for 100 parts b.w. of (a+b+c).

The combustible soot disaggregating agent according to the invention may appear in any desired shape, either regular such as cubes, cylinders, polygons of any type, spheres, or random shape. In the case of fireplaces normally operated with wood, the shape of a log, either large or small, is preferred both for aesthetical and practical reasons. The size of the log may be selected at will and will preferably be that of the logs normally used in fireplaces, generally between 10 and 40 cm in length.

The process for manufacturing aggregates according to the invention may be of the same type as that conventionally used when manufacturing a sawdust/paraffin wax log or when manufacturing a merely compressed log, except that the combustible material (a) is admixed with the anti-soot agent (b) before coating or sticking with the agent (c) or during same. The resulting mixture of (a+b+c) may be press-molded or extruded or poured into molds. If the binder is used as a solution or dispersion in a solvent, the latter is removed thereafter by vaporizing or drying. The constituents of the aggregate are preferably distributed in a substantially homogeneous manner, although the agent (b) can also be arranged at the center or as successive layers.

The aggregate, for example a log, can thereafter be wrapped up, whenever desired, preferably with a combustible material to make the ignition easier, e.g. paper, cardboard, waxy paper or cardboard, or paper or cardboard treated in some way to be more easily ignited.

The following is a non limiting example of the invention.

EXAMPLE 400 parts by weight of dry sawdust of 1 mm average diameter are admixed with 200 parts by weight of a mixture by equal parts b.w. of ammonium sulfate and phosphorus pentoxide and with 600 parts by weight of molten paraffin wax at 80° C. After partial cooling to solidify at least partly the paraffin wax, the mixture is extruded and extrudates of about 30 cm in length and 12 to 15 cm in average diameter are cut therefrom. These extrudates have the aspect of logs. These logs are wrapped in individual paper bags, which however is not compulsory.

A log of the above type is placed in a fireplace where the fire had been previously fully extinguished and where wood had been used as the usual fuel to such an extent that the chimney necessitated cleaning. The log is ignited and burns with flame for about 30 min to 2 hours depending on its size. Heat is evolved which reheats the chimney and softens the deposits therein, while the active agent begins to treat the flue. Thereafter the log continues to burn slowly while evolving combustion gas, which can last for example for 2 to 6 hours. The active material continues to operate and it can be checked thereafter that the deposits in the chimney have been strongly reduced, when not suppressed, or have been made crumbly which makes their removal easy. When treating strongly soiled chimneys, the treatment can be renewed or several logs can be combusted together.

Thus after a few hours a result is obtained which is similar to, or better than, that obtained in 8 to 10 days of treatment with the powders of the trade.

It can be remarked that it is not necessary to place the log according to the invention into a fire already ignited and kept alive. On the contrary the best results are obtained when operating in the substantial absence of any other combustible material or already ignited fire.

Good results have also been obtained with a similar log comprising, as the active agent, a mixture of 40 parts b.w. of ammonium sulfate with 60 parts b.w. of potassium chloride or a mixture of 30 parts b.w. of potassium acetate with 70 parts b.w. of ammonium sulfate with or without added copper nitrate.

To summarize, the use of a chimney cleaning, soot disaggregating agent according to the invention preferably implies the following process steps:

1/ providing the fireplace which is free of fire with a solid combustible agent comprising as essential constituents:

a/ a solid particulate combustible cellulosic material, b/ a chemical and/or catalytic agent able to disaggregate soot, and c/ a binder, and 2/ igniting and burning said agent in said fireplace, whereby the evolved gas treats the chimney and disaggregates the deposits therein.

What is claimed as our invention:

1. A combustible solid agent for disaggregating soot and tarry deposits in chimney flues, which comprises as essential aggregated constituents:

a/ a solid particulate combustible cellulosic material, b/ a chemical and/or catalytic agent able to disaggregate soot, and c/ a binder, wherein the relative proportions of said essential constituents are, by weight, from 20 to 80% of (a), from 10 to 40% of (b) and from 10 to 70% of (c) for 100 parts of (a+b+c).

2. A combustable solid agent according to claim 1, wherein the relative proportions are, by weight, from 25 to 45% of (a), from 15 to 30% of (b) and from 40 to 65% of (c) for 100 parts of (a+b+c).

3. A combustible solid agent according to claim 1, in the form of a log of 10 to 40 cm in length.

4. A combustible solid agent according to claim 1, in the form of a log having an autonomous combustion time with flame of from 30 min to 2 hours.

5. A combustable solid agent according to claim 1, wherein the solid particulate combustible cellulosic material (a) consists essentially of wood particles and the binder (c) is paraffin wax, an adhesive material, a thermoplastic resin, an amylaceous material or stearic acid.

6. A combustible solid agent according to claim 5, wherein the agent (b) comprises an ammonium salt.

7. A combustible solid agent according to claim 5, wherein the agent (b) comprises phosphorus pentoxide or phosphoric acid and an ammonium salt.

8. A combustible solid agent according to claim 5, wherein the agent (b) comprises a mixture of phosphorus pentoxide and ammonium salt in a proportion of 10–90% by weight of the former and 90–10% by weight of the latter.

9. A combustible solid agent according to claim 8, wherein the ammonium salt is ammonium sulfate.

10. A combustible solid agent according to claim 5, wherein the agent (b) comprises ammonium phosphate.

11. A combustible solid agent according to claim 1, in the form of a log.

12. A process for manufacturing a combustible solid agent for disaggregating soot and tarry deposits from chimney flues, comprising the steps of admixing:

a/ a solid particulate combustible cellulosic material, b/ a chemical and/or catalytic agent able to disaggregate soot, and c/ a binder, the relative proportions thereof being by weight 20 to 80% of (a), 10 to 40% of (b) and 10 to 70% of (c), for 100 parts of (a+b+c) and shaping the resultant mixture.

13. A process according to claim 12, wherein the component (c) is paraffin wax and the admixing is carried Out with melted paraffin wax, the resultant mixture is at least partly cooled down to solidify at least partly the paraffin wax and the mixture is extruded thereafter.

14. A process for disaggregating soot and tarry deposits from the chimney flue of a fireplace or combustion device, said flue requiring cleaning of soot and tarry products accumulated therein, comprising providing in said fireplace, in the substantial absence of fire, a solid combustible agent comprising as essential elements:

a/ a solid particulate combustible cellulosic material, b/ a chemical and/or catalytic agent able to disaggregate soot, and c/ a binder and igniting and combusting said agent in said fireplace, the percentage and amounts of (a), (b), and (c) being effective to disaggregate the soot and tarry products substantially, thereby cleaning said flue.

15. A process according to claim 14, wherein the solid combustible agent which comprises the constituents (a), (b) and (c) is in the form of at least one log and constitutes the only combustible material in the fireplace, the relative proportions thereof being by weight 20–80% of (a), 10–40% of (b) and 10–70% of (c) for 100 parts of (a+b+c).

16. A Process according to claim 15, wherein the cellulosic material (a) comprises wood particles and the binder (c) is paraffin wax, an adhesive material, a thermoplastic resin, an amylaceous material or stearic acid.

17. A process according to claim 16, wherein the relative proportions of the constituents (a), (b) and (c) are, by weight, from 25 to 45% of (a), from 15 to 30% of (b) and from 40 to 65% of (c) for 100 parts of (a+b+c).

18. A Process according to claim 16, wherein the constituent (b) comprises phosphorus pentoxide or phosphoric acid and an ammonium salt.

19. A Process according to claim 16, wherein the constituent (b) comprises ammonium phosphate.

20. Process according to claim 16, wherein the constituent (b) comprises phosphorus pentoxide and ammonium sulfate in proportions of 10–90% by weight of the former to 90–10% by weight of the latter.

* * * * *